United States Patent [19]

Okada

[11] Patent Number: 5,024,439

[45] Date of Patent: Jun. 18, 1991

[54] SLOT MACHINE

[75] Inventor: Kazuo Okada, Tokyo, Japan

[73] Assignee: Kabushiki Kaisha Universal, Tokyo, Japan

[21] Appl. No.: 570,593

[22] Filed: Aug. 21, 1990

[30] Foreign Application Priority Data

Aug. 21, 1989 [JP] Japan ..... 1-214595

[51] Int. Cl.[5] ..... A63F 5/04

[52] U.S. Cl. ..... 273/143 R

[58] Field of Search ..... 273/143 R, 143 C, 143 D, 273/143 E, 138 A

[56] References Cited

U.S. PATENT DOCUMENTS 4,353,554 10/1982 Fisher ..... 273/143 R
4,373,727 2/1983 Hooker et al. ..... 273/143 R
4,508,345 4/1985 Okada ..... 273/143 R
4,618,150 10/1986 Kimura ..... 273/143 R
4,858,932 8/1989 Keane ..... 273/143 R

*Primary Examiner*—Benjamin Layno
*Attorney, Agent, or Firm*—Young & Thompson

[57] ABSTRACT

Whether or not a game of a slot machine can result in a hit is determined before the symbol series stop moving, and preferably when a start lever is manipulated for starting the motion of the symbol series. For a game that can be a hit, the speed of movement of the symbol series is switched from a high speed to a low speed, or the speed is set at a low speed from the outset. For a game that cannot be a hit, the symbol series move at a high speed from the outset. From the difference between the speeds of movement, a player can know whether the game can be a hit even while the game is still in progress.

8 Claims, 6 Drawing Sheets

SLOT MACHINE

This application is related to a co-pending application Ser. No. 07/570874 filed Aug. 22, 1990.

BACKGROUND OF THE INVENTION

The present invention relates to a slot machine capable of visually suggesting that a game now being played will result in a hit.

A slot machine has a plurality, e.g., three to five, of reels with a plurality of symbols in a series about each outer periphery thereof. These reels start rotating when a game starts. After the rotation of each reel reaches a constant speed, a stop control can be executed. This stop control for each reel rotating at a constant speed is effected upon actuation of a stop button in the case of a slot machine of the manual stop type, or by the operation of an automatic stop device in the case of a slot machine of the automatic stop type. When all the reels have stopped, the presence or absence of a hit is determined according to the combination of symbols on the respective reels stopping on at least one winning line. The number of winning lines is determined by the number of inserted coins. Coins corresponding in number to the rank of the hit are paid out.

As used herein, the term "coins" includes tokens.

In a conventional slot machine, at a certain time during the period between inserting the coins and starting the reel stop control, a judgment is made by using random numbers whether or not the game is to have a hit; and if a hit is to occur, its rank is also determined. In accordance with this judgment, the reel stop control is effected. In a slot machine of the manual stop type, even a game which otherwise could be a hit may result in a lost game because the reel stop positions are restricted. In this case, the hit is carried over to the next game.

Players naturally want a big hit with many coins paid out or a bonus game having a high hit probability. But such special hits cause many coins to be paid out. In order to maintain a stable payout rate, the probability of occurrence of special hits is controlled by using random numbers as described before, to inhibit concentrated occurrences of special hits. With a limited or low probability of occurrence of special hits, players tend to have the impression that a special hit may suddenly occur after a number of repeated games. Most of the games therefore arouse the player's interest only after the reels stop, with an uninteresting wait during the period from the start of rotation of the reels to their stopping. This is one of the major reasons that known games are monotonous and dull. The same problem is also associated with a slot machine of the type wherein symbols are displayed on a CRT instead of reels.

OBJECT OF THE INVENTION

It is therefore an object of the present invention to provide a slot machine capable of visually suggesting that the game now being played will result in a hit.

SUMMARY OF THE INVENTION

In order to achieve the above and other objects and advantages of this invention, the speed of movement of the series of symbols is determined in accordance with a prior decision as to whether there will be a hit. For a game that can have a hit, the symbol series are moved at a speed different from the speed used for a game that cannot have a hit. A player thereby can be given an indirect suggestion, by the difference between the speeds, as to whether the game can be a hit. This speed difference may be achieved by moving the symbol series at a low speed from the beginning, or by changing the speed during movement of the symbol series. In a slot machine of the manual stop type, the stop operation by an operator can be advantageously carried out with proper timing because the speed of the symbol series is low. Conversely, the speed for a game that can have a hit may be faster than for a game that cannot have a hit.

According to the present invention, whether a game can have a hit is thus foretold while the symbol series are in motion. The monotony of the game is thus relieved, with increased enjoyment by the player. Such a prior suggestion preferably is given during a game that can have a special hit with a large award. However, it is not limited thereto, as such a prior suggestion may also be given during a game which can have only a small hit.

BRIEF DESCRIPTION OF THE DRAWINGS

The above and other objects and advantages of the present invention will become apparent from the following detailed description of the invention when read in connection with the accompanying drawings, in which.

DETAILED DESCRIPTION OF THE INVENTION

Figure 1:
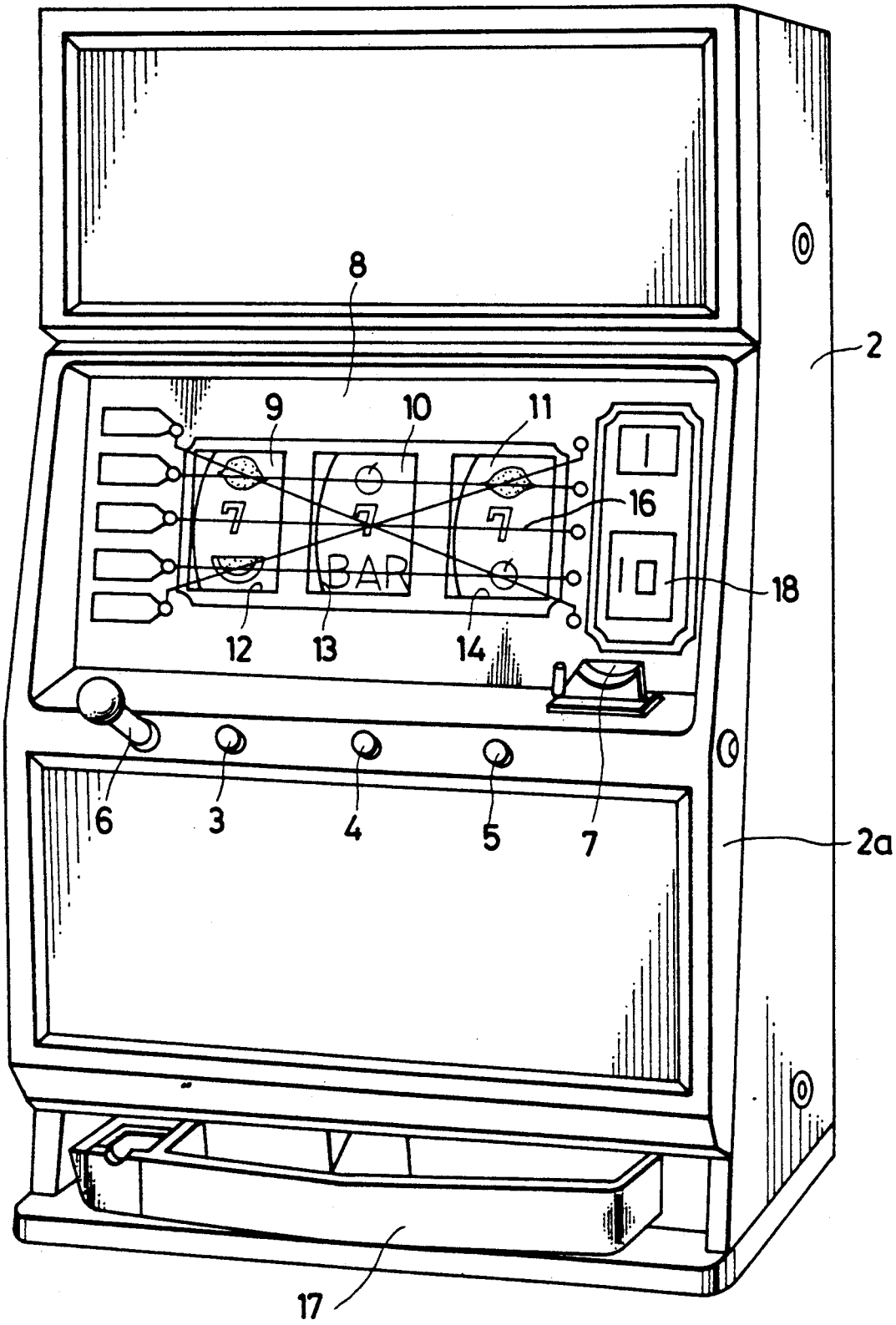
FIG. 1 is a front perspective view showing an embodiment of the slot machine according to the present invention.

Referring now to FIG. 1 showing a perspective view of a slot machine according to the present invention, the slot machine 2 has a front door 2*a* capable of being opened and closed. The front door 2*a* has stop buttons 3 to 5, start lever 6 and coin inlet 7 mounted thereon. A front panel 8 is fitted in the front door 2*a* above the stop buttons 3 to 5. First to third reels 9 to 11 are rotatably mounted at the back of the front panel 8. On the outer periphery of each reel 9 to 11, various symbols such as "lemon", "7", and "bell" are drawn and can be viewed from three windows 12 to 14 formed in the front panel 8. A plurality of winning lines 16 are drawn over the windows 12 to 14 which are made effective in accordance with the number of inserted coins.

Upon actuation of the start lever 6 after coins are inserted into the coin inlet 7, the reels 9 to 11 start rotating simultaneously. After the rotating reels 9 to 11 reach a constant angular velocity, the stop buttons 3 to 5 can be actuated by a player. After the stop buttons 3 to 5 are operated, the stop control begins to operate and the reels 9 to 11 stop, and certain symbols are aligned on an effective winning line, these symbols being determined in accordance with the presence or absence of a predetermined hit and its rank. If a combination of three symbols stopping at the effective winning line is a hit symbol combination, coins corresponding in number to the rank of the hit are paid out into a coin saucer 17. If the stop buttons 3 to 5 are not operated with a predetermined period of time, each reel 9 to 11 is stopped by a known automatic stop mechanism. Reference numeral 18 represents a display unit for displaying the number of coins to be paid out.

Figure 2:
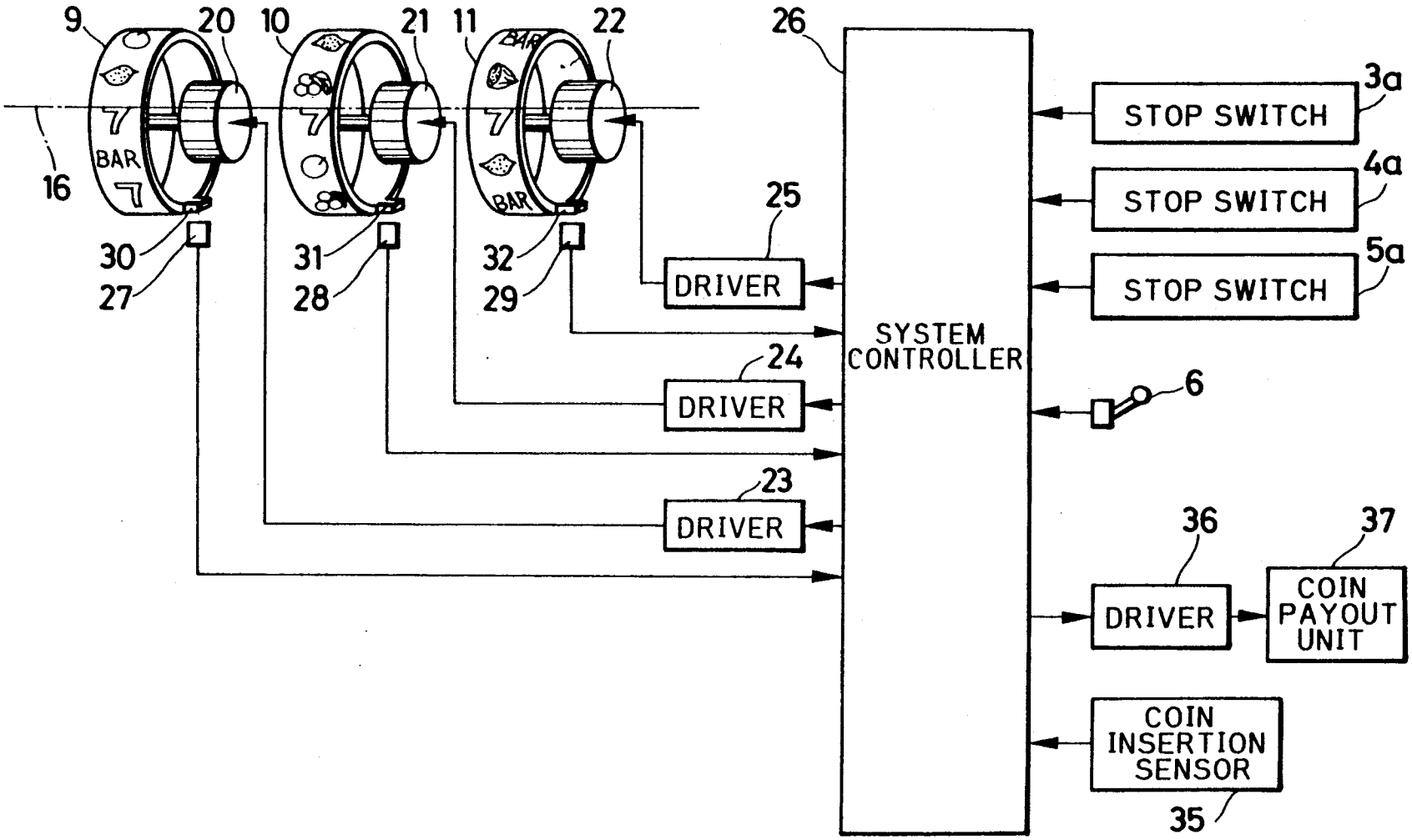
FIG. 2 is a schematic diagram showing the electric circuit arrangement of the slot machine shown in FIG. 1.

Referring to FIG. 2 showing the electric circuits of the slot machine 2, pulse motors 20 to 22 for driving the respective reels 9 to 11 are connected via corresponding drivers 23 to 25 to a system controller 26. Photosensors 27 to 29 detect light interrupting members 30 to 32 mounted on the reels 9 to 11 so that reference positions of the reels 9 to 11 can be detected. Connected to the system controller 26 are stop switches 3*a* to 5*a* for outputting stop signals upon actuation of the stop buttons 3 to 5, a start switch 6*a* to be operated by the start lever 6, a coin insertion sensor 35 for detecting a coin inserted into the coin inlet 7, and a coin payout unit 37 which is driven by a driver 36. The start switch 6*a* outputs a start signal when the start lever 6 is manipulated. The coin insertion sensor 35 outputs a random number generation signal when a coin is detected by the coin insertion sensor 35.

Figure 3:
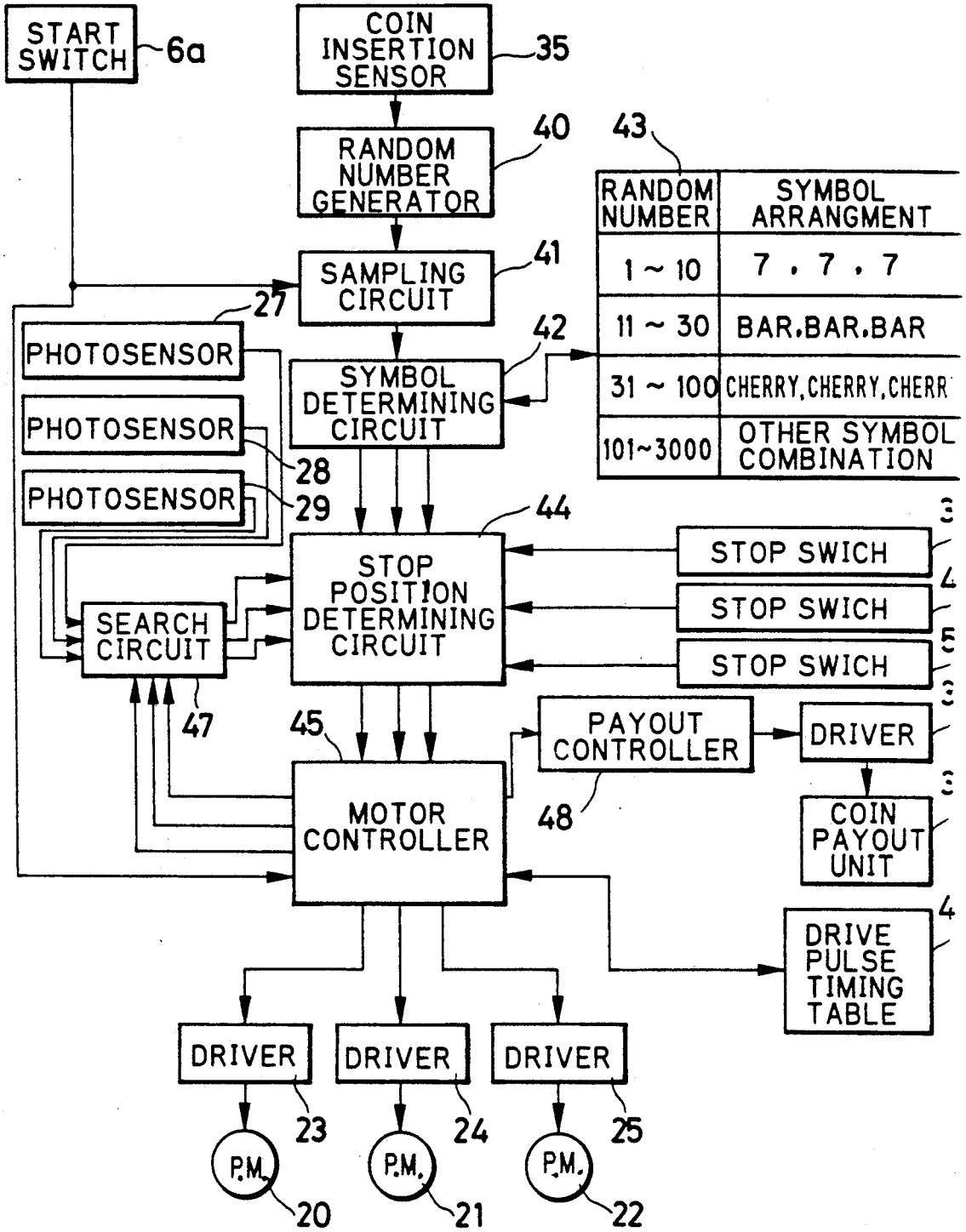
FIG. 3 is a functional block diagram of the system controller shown in FIG. 2.

Referring to FIG. 3 illustrating the function of the system controller 26, a random number generator 40 is started in operation upon insertion of a coin, and generates a random number from "1" to "3000". The random number generator 40 is connected to a sampling circuit 41 which starts sampling upon reception of the start signal. The sampling circuit 41 is preferably constructed such that it does not sample the same random number again in 3000 games. The sampling circuit 41 is connected to a symbol determining circuit 42 which refers to a symbol table 43, using the sampled number as a key thereby to determine a symbol combination of the three symbols thereof. The data of each determined symbol is sent to a stop position determining circuit 44 to which are connected the stop switches 3*a* to 5*a* and a motor controller 45 for controlling the pulse motors 20 to 22.

The stop position determining circuit 44 receives the stop signals from the stop switches 3*a* to 5*a* and controls the pulse motors 20 to 22 to stop them. In this stop control, by referring to the revolution position signals of the reels 9 to 11 supplied from a search circuit 47 to be described later, the stop position determining circuit 44 controls the motor controller 45 so that the symbols determined by the symbol determining circuit 42 are caused to stop on an effective winning line 16. Note that if the timings of actuating the stop buttons 3 to 5 and of actually stopping the reels 9 to 11 are considerably different, players feel the manner of stopping to be unnatural. For this reason, a shift control (e.g., by the amount corresponding to a plurality of symbols) which seems natural to the players is carried out in order to stop the symbols on a winning line. Consequently, a symbol combination determined by the symbol determining circuit 24 might not necessarily be established. In such a case, the stop control for a hit combination is carried over to the next game.

Figure 4:
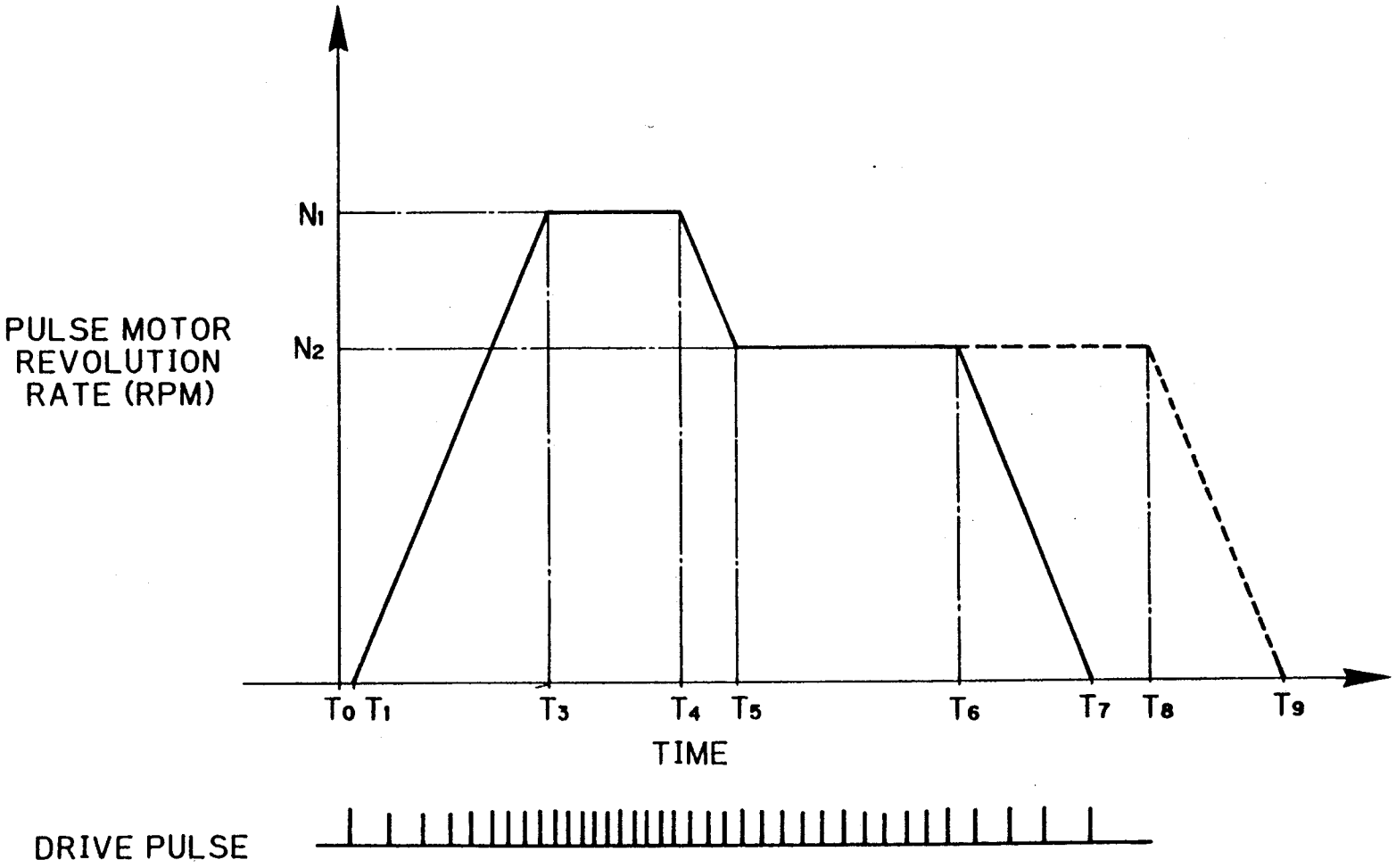
FIGS. 4 to 6 are timing charts showing the relationships between drive pulses and pulse motor revolution rates.
Figure 5:
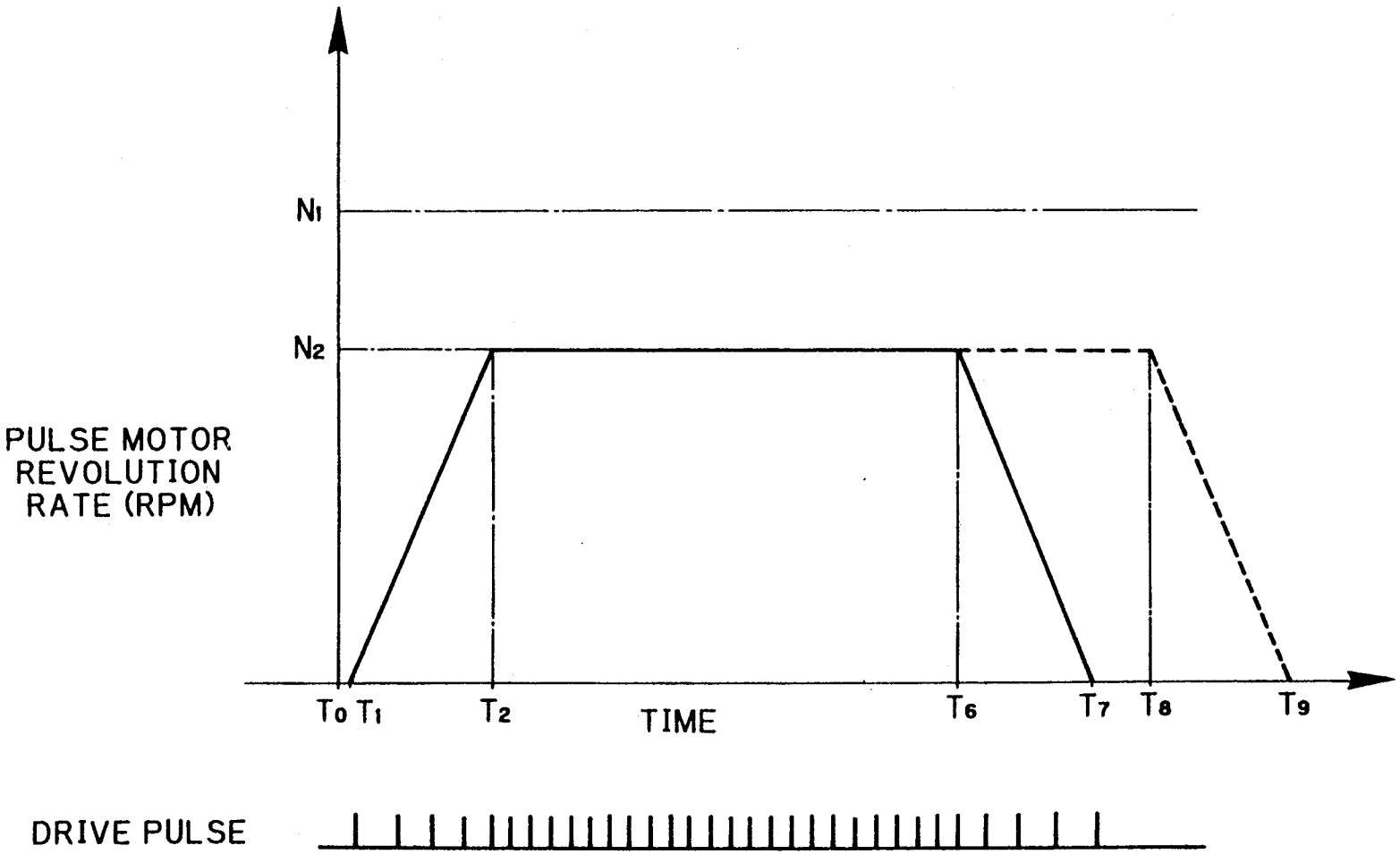
Figure 6:
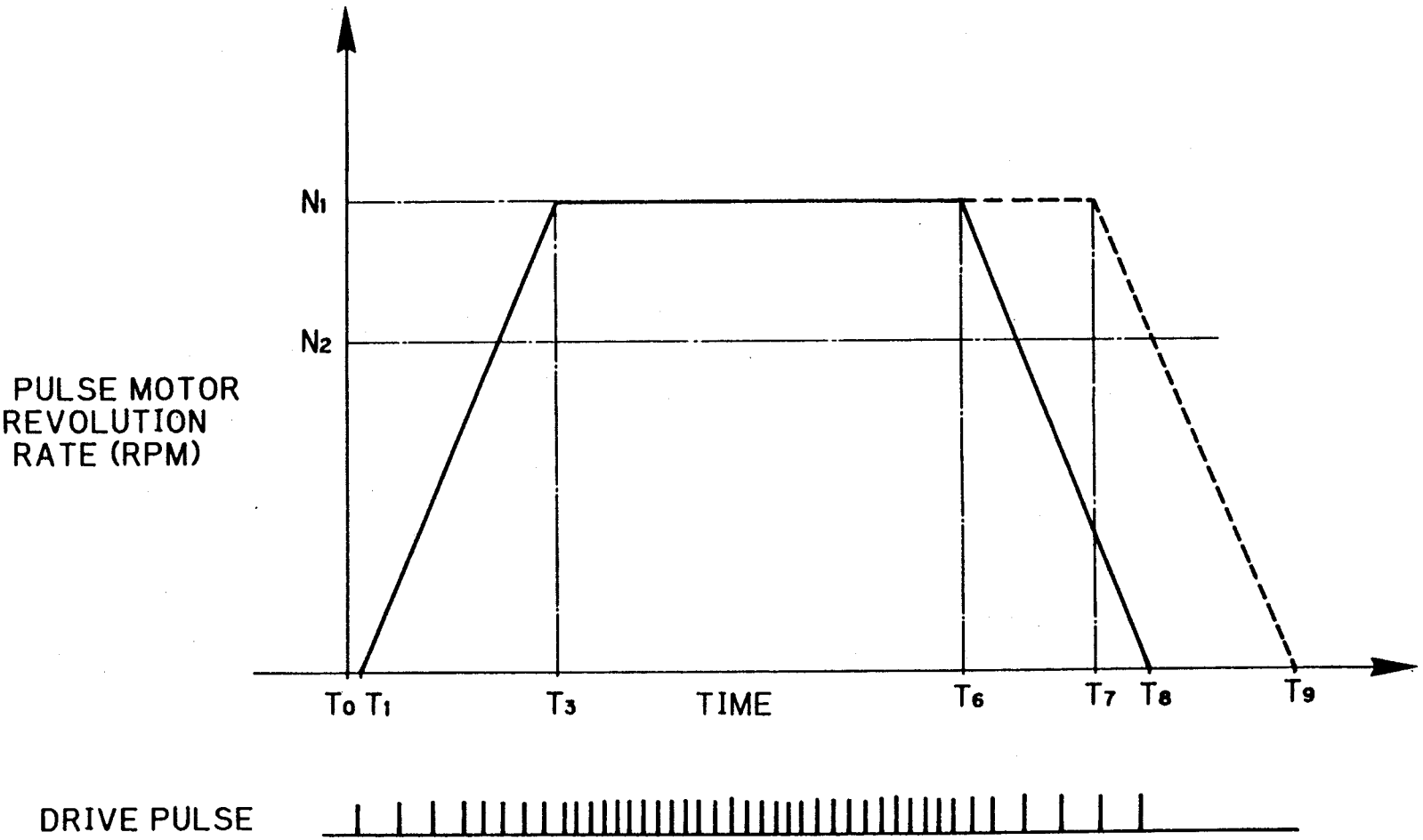

Connected to the motor control circuit 45 are the start switch 6*a*, a drive pulse timing table 46, the search circuit 47, and a payout controller 48. The drive pulse timing table 46 stores the timing data for outputting drive pulses from the motor control circuit 45 to the pulse motors 20 to 22. If symbol "7" signals are outputted for all reels from the stop position determining circuit 44 to the motor control circuit 45, the motor control circuit 45 decelerates the pulse motors 20 to 22 rotating at a constant speed after a lapse of a predetermined time. For instant, as shown in FIG. 4, the stop position determining circuit 44 sends drive pulses to the pulse motors 20 to 22 such that the constant revolution rate or speed of $N_1$ rpm is lowered from time $T_4$, and at time $T_5$ it reaches a constant revolution rate of $N_2$ rpm. If the symbol combination "777" has been carried over from the previous game, as shown in FIG. 5 the circuit 44 sends drive pulses to the pulse motors 20 to 22 such that the motors are accelerated not to the constant revolution rate of $N_1$ rpm, but rather to the constant revolution rate of $N_2$ rpm. If a symbol combination other than the symbol combination "777" is to be established, as shown in FIG. 6 drive pulses are sent to the pulse motors 20 to 22 such that the motors are driven at a constant revolution rate of $N_1$ rpm. As seen from FIG. 5, the revolution rate of each pulse motor is controlled by changing the period of the drive pulses.

The search circuit 47 checks the positions of symbols on the rotating reels 9 to 11 in accordance with the numbers of drive pulses counted from the time when the photosensors 27 to 29 detect the reference positions. The obtained revolution position signals are sent to the stop position determining circuit 44. When it is found that the symbol combination is a hit, after all the pulse motors 20 to 22 have stopped, the payout controller 48 causes the driver 36 and coin payout unit 37 to pay out coins corresponding in number to the rank of the hit.

Next, the operation of this embodiment will be described with reference to FIGS. 4 to 6. When a coin is inserted into the coin inlet 7 at time $T_0$ shown in FIG. 4, the coin insertion sensor 35 sends a random number generation signal to the random number generator 40 which then starts operating. When the start lever 6 is manipulated at time $T_1$, the start signal is sent to the sampling circuit 41 and motor controller 45. The sampling circuit 41 samples a random number from the random number generator 40 and sends it to the symbol determining circuit 42. If the sample random number falls within the range from "1" to "10", it means the machine will display a hit symbol combination "777" having a large reward. The symbol determining circuit 42 refers to the symbol table 43 to determine the symbols for the reels 9 to 11 as "7", and sends the symbol signals representative of the symbol "7" to the motor controller 45. The motor controller 45 starts the pulse motors 20 to 22 at time $T_1$ in accordance with the data in the drive pulse timing table 46, and causes them to gradually increase their speed of rotation. After the pulse motors 20 to 22 reach the constant revolution rate $N_1$ rpm at time $T_3$, the stop buttons 3 to 5 can be actuated. Deceleration starts at time $T_4$, and at time $T_5$ the pulse motors are driven in a low constant revolution rate of $N_2$ rpm. Upon actuation of a stop button during the period from time $T_3$ to $T_8$, the corresponding pulse motor starts being decelerated to thereby make the predetermined symbol stop on the winning line. If the stop buttons are not actuated during this period, the pulse motors 20 to 22 start undergoing the stop control after time $T_8$ as indicated by the broken line.

For instance, upon actuation of the stop button 3 during the period from time $T_3$ to $T_4$, a stop position signal is outputted from the stop position determining circuit 44 to the motor controller 45. Referring to the revolution position signal from the search circuit 47, the motor controller 45 executes a stop control for the pulse motor 20 to stop the symbol "7" of the first reel 9 on the winning line 16. The remaining two pulse motors 21 and 22 are decelerated from time $T_4$, and rotate at a constant revolution rate of $N_2$ rpm beginning at time $T_5$. If the stop button 4 is actuated before or after time $T_5$ for example, the stop position determining circuit 44 and motor controller 45 execute a stop control for the pulse motor 21 to stop the symbol "7" of the second reel on the winning line 16. If the stop button 5 is actuated at time $T_6$, the motor controller 45 starts decelerating the pulse motor 22 rotating at the constant revolution rate of $N_2$ rpm so as to stop it at time $T_7$. After all the reels stop, the symbols on the reels 9 to 11 on the effective winning line 16 are all "7", thereby to establish a special hit symbol combination "777". After all the reels 9 to 11 stop, in accordance with the rank of the displayed hit symbol combination, the payout controller 45 sends a payout signal to the payout unit 37 to pay out a predetermined number of coins. It is obvious that the order of actuating the three stop buttons is arbitrary.

With a slot machine of the manual stop type, even if a hit of "777" is possible, this "777" might not be established in some cases by using only the reel stop position shift control, depending on the timing of actuating the stop buttons 3 to 5 and the time $T_8$ which is the onset of automatic stopping. In such a case, the hit is carried over to the next game, wherein the pulse motors 20 to 22 are driven at a low constant revolution rate of $N_2$ rpm as shown in FIG. 5. Specifically, the motor controller 45 sends drive pulses as shown in FIG. 5 from time $T_1$ to the pulse motors 20 to 22 to rotate them. At time $T_2$ the pulse motors 20 to 22 reach the low revolution rate of $N_2$ rpm, and thereafter the stop buttons can be actuated. Upon actuation of the stop buttons, the motor controller 45 outputs stop position signals to stop the pulse motors 20 to 22 with the symbols "7" on the reels 9 to 11 on the effective winning line 16. In this case also, the same procedure is repeated if the symbol combination "777" is not actually realized. If the presence or absence of a hit is determined prior to the rotation of the reels, the constant revolution rate of $N_2$ rpm shown in FIG. 5 may be used for the game during which a hit can occur, instead of changing the reel speed in two steps as shown in FIG. 4.

If the random number sampled at time $T_1$ falls within the range from "11" to "3000", the symbol determining circuit 42 refers to the symbol table 43 to determine a symbol combination. The symbol determining circuit 42 supplies the stop position determining circuit 44 with the symbol signals corresponding to the determined symbol combination. The motor controller 45 supplied with the symbol signals from the stop position determining circuit 44 sends drive pulses as shown in FIG. 6 to the pulse motors 20 to 22 to drive them at the high revolution rate of $N_1$ rpm. During time $T_3$ to $T_7$, the stop buttons 3 to 5 can be actuated. For instance, if the stop button is actuated at time $T_6$, the corresponding pulse motor is controlled to stop the predetermined symbol on the winning line. If the stop buttons are not actuated, the pulse motors are automatically decelerated from time $T_7$ and stop at time $T_9$ as indicated by the broken line.

In the above-described embodiment, for a game that can have a special hit with a large award, the pulse motors are driven at a low revolution rate after the lapse of a predetermined time. Instead, after the stop button is first actuated, the remaining two reels may be switched to the low revolution rate. With such an arrangement, games can proceed in an unexpected and hence more interesting manner. Furthermore, in the above embodiment, the reels 9 to 11 are driven at the low revolution rate so that stop buttons can be advantageously actuated at suitable times so as to obtain the symbol "7". However, the reels may be rotated at the high revolution rate for the game that can have a hit, without giving such an advantage. Furthermore, for a hit other than "777" with a smaller award, the speed of rotation of the reels may be changed.

The present invention is applicable to slot machines not only of the manually stopped type but also of the automatically stopped type lacking stop buttons. Furthermore, in the above embodiment, although a series of symbols is carried on the outer periphery of a reel, it will be understood that this invention is equally applicable to a video-type slot machine with symbol series displayed on a display unit. Coins may be paid out each time a hit is made, or the number of coins obtained may be added to a credit counter to display the cumulative result each time a hit occurs. In the latter case, without inserting a coin, the game can be started upon manipulation of the start lever 6 and the contents of the credit counter reduced correspondingly. A coin number designation button may preferably be provided so as to designate the number of coins to be considered to have been inserted.

Although the invention has been described in detail above with reference to a preferred embodiment, it is to be understood that various changes and modifications within the scope and spirit of the invention will be apparent to people of ordinary skill in this technological field. Thus, the invention should be considered as being limited only by the scope of the appended claims.

What is claimed is:

1. A slot machine having a plurality of series of symbols movable past a viewing window during the playing of a game, comprising:

hit determining means for determining before said symbol series stop moving whether said game can be a hit; and speed setting means responsive to said hit determining means for changing the speed of movement of at least one of said symbol series in accordance with a determination made by said hit determining means so that the possibility of said hit can be visually suggested while the symbols are still moving.

2. A slot machine according to claim 1, further comprising stop means for stopping the motion of each of said symbol series.

3. A slot machine according to claim 1, wherein, for a game that can be a hit, each of said symbol series moves initially at a first speed and moves at a second speed lower than said first speed after a predetermined time has elapsed from the beginning of movement of each of said symbol series.

4. A slot machine according to claim 3, wherein, if said game that can be a hit becomes instead a lost game, each of said symbol series moves at said second speed in the next game from the beginning of said next game.

5. A slot machine according to claim 4, wherein said speed setting means changes said speed only for a hit with a large award to a player.

6. A slot machine according to claim 1, wherein said symbol series are carried on the outer peripheries of reels rotated by pulse motors.

7. A slot machine according to claim 1, wherein, for a game that can be a hit, each of said symbol series moves initially at a first speed and, after one of said symbol series stops, the remaining symbol series move at a second speed lower than said first speed.

8. A slot machine according to claim 1, wherein, for a game that can be a hit, each of said symbol series moves at a first speed and, for a game that cannot be a hit, thereafter moves at a second speed higher than said first speed.

* * * * *